United States Patent [19]

Levine

[11] Patent Number: 4,979,635

[45] Date of Patent: Dec. 25, 1990

[54] EASY OPENING CAN WITH INTERNAL RECLOSURE FLAP

[76] Inventor: Joshua Levine, 31 Pilgrim La., Guilford, Conn. 06437

[21] Appl. No.: 450,395

[22] Filed: Dec. 14, 1989

[51] Int. Cl.[5] ..... B65D 41/32

[52] U.S. Cl. ..... 220/269; 220/258; 220/336

[58] Field of Search ..... 220/258, 269, 336

[56] References Cited

U.S. PATENT DOCUMENTS

| | | | |
|---|---|---|---|
| 4,433,792 | 2/1984 | Mandel | 220/269 |
| 4,463,866 | 8/1984 | Mandel | 220/269 |
| 4,605,141 | 8/1986 | Won | 220/269 |
| 4,673,099 | 6/1987 | Wells | 220/269 |

*Primary Examiner*—Stephen Marcus
*Assistant Examiner*—Nova Stucker
*Attorney, Agent, or Firm*—William W. Jones

[57] ABSTRACT

The easy open beverage can has a weakened spout portion formed in one end which is punched out from the can end and pivoted into the interior of the can. A punch tab which remains connected to the can end is used to punch the spout portion. A closure flap is foldably connected to and underlies the punch tab, and is connected to the can by the rivet which also connects the tab to the can. The closure flap is swung about the rivet to close the can opening by twisting the punch tab about the rivet. The closure flap may have a seal-enhancing polymer coating on it and a lightly biased peripheral skirt.

2 Claims, 2 Drawing Sheets

EASY OPENING CAN WITH INTERNAL RECLOSURE FLAP

This invention relates to a can for a beverage which can is opened by means of a hinged tab on the lid which when pivoted upwardly, punches out a preweakened area on the can lid. More particularly, this invention relates to an easy opening can of the character described having an improved closure flap mounted on the lid.

Beverage cans which have lids with preformed openings are known in the prior art, and are generally denoted "easy opening" cans. Such cans can include a tab on the lid which is pulled off of the lid to form the opening in the can. These cans may be reclosed by the use of a separate elastomeric plug so as to retain beverage purity and carbonation. One drawback found with this type of can relates to the litter problem arising from the use of completely detachable tabs.

Another type of prior art easy can involves the use of a punch tab secured to the can lid by a rivet which punch tab is not removed from the can when the opening is formed. The punch tabs are mounted on the can lid adjacent to the preweakened opening-forming portion thereof, and the tabs are pivoted upward about the rivet causing a portion of the tab adjacent to the rivet to push the weakened portion of the lid down into the can. Both the tab and the weakened portion of the lid remain secured to the can, thus eliminating the aforesaid litter problem. U.S. Pat. No. 3,967,752 granted July 6, 1976 to Reynolds Metals Company discloses one of the many forms of the non-removable tab, easy open cans of the prior art.

One problem that has been encountered in connection with the aforesaid non-removable tab easy open cans relates to the inability to reclose them because the pivot tab obstructs one side of the opening, and because the deflected lid material which forms the opening remains attached to the lid after the opening is formed.

U.S. Pat. Nos. 4,433,792 granted Feb. 28, 1984 to G. Mandel; 4,442,950 granted Apr. 17, 1984 to T. P. Wilson; and 4,720,022 granted Jan. 19, 1988 to R. A. Gomes have recognized ad attempted to deal with this problem. The solutions offered by each of these patents are similar in that all use a three dimensional contoured punch tab which is larger than the opening formed in the can, and which includes a portion thereof which can be swung over the opening and then pushed down to close the opening. In order to properly close the opening, the tabs must include a dished out central plug panel with relatively vertical side edges that can snugly abut the edges of the opening. This interferes with end stackability of the cans since the base of one can cannot readily nest into the chimed top of another can, as is commonly possible without these modified punch tabs. The plug panel must be pivoted vertically up and down to open and close the can opening. This tens to weaken the rivet and may result in rupture of the rivet or the plug panel. The fact that the plug panel physically enters the can and can opening also may result in dislodgement of the punched portion of the can end, which can create an ingestion danger if the beverage is subsequently consumed directly from the can.

This invention relates to an improved closure for an easy opening can of the punch type which includes an unobtrusive closure flap which is connected to the can lid by the punch tab rivet, but which does not stress the rivet when used to reclose the can. The closures flap lies closely adjacent to the can end whereby end stacking of the cans is not impeded. The closure flap is formed as a unitary part of the punch tab. To operate the closure flap, the punch tab is merely swung or twisted about the rivet through a 180 degree arc. This action drags the closure flap over the can lid through a like 180 degree arc whereby the closure flap will overlie the can opening. To reopen the can, the punch tab is merely twisted back to its original position thereby dragging the closure flap with it. The closure flap may have a seal-enhancing polymer, such as polyethylene, coated on its surface which faces the can lid, whereby the degree of closure is enhanced. The periphery of the closure flap may be permanently flexed to form a peripheral skirt is lightly biased against the can end to further enhance the closure produced.

It is therefore an object of this invention to provide an improved easy open beverage can which includes a closure flap for reclosing the opening formed in the can lid.

It is a further object of this invention to provide an improved beverage can of the character described which includes a pivotable punch tab connected to the can lid, and a common rivet connecting the punch tab and closure flap to the can.

It is an additional object of this invention to provide an improved beverage can of the character described wherein the punch tab and closure flap are portions of the same component of the can.

It is another object of the invention to provide an improved beverage can of the character described wherein the closure flap slides over the lid of the can between open and closed positions thereon.

These and other objects and advantages of the invention will become more readily apparent from the following detailed description of a preferred embodiment thereof when taken in conjunction with the accompanying drawings, in which.

Figure 1:
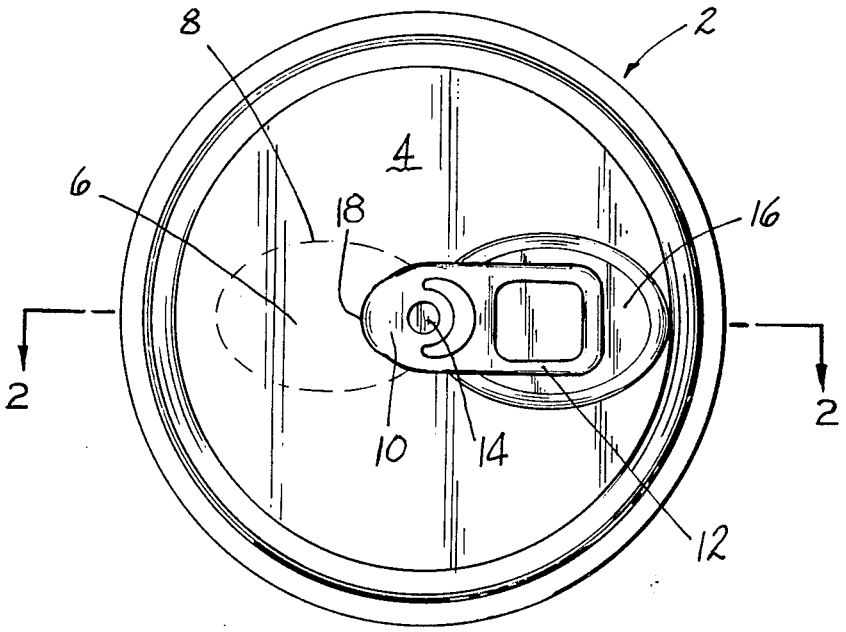
FIG. 1 is a plan view of the lid of a beverage can which employs the easy open punch tab/closure flap of this invention.

Referring now to the drawings, there is shown in FIG. 1 a preferred embodiment of an easy open beverage can employing the punch tab/closure flap mechanism of this invention. The beverage can is denoted generally by the numeral 2. The top lid 4 of the can 2 has an opening-forming portion 6 which is defined by a weakened line 8, as is conventional in the prior art. A punch tab 12 formed integral with a punching portion 10 is mounted on the lid 4 of the can 2 by means of a rivet 14 about which the tab 12 and portion 10 pivot. In a conventional manner, the punch tab 12 is pivoted upwardly about rivet 14 to pivot the punching portion 10 downwardly about the rivet 14 onto the opening-forming portion 6 in the lid 4. A closure flap 16 is connected to the punching portion 10 of the punch tab 12 by means of a fold line or score 18.

Figure 2:
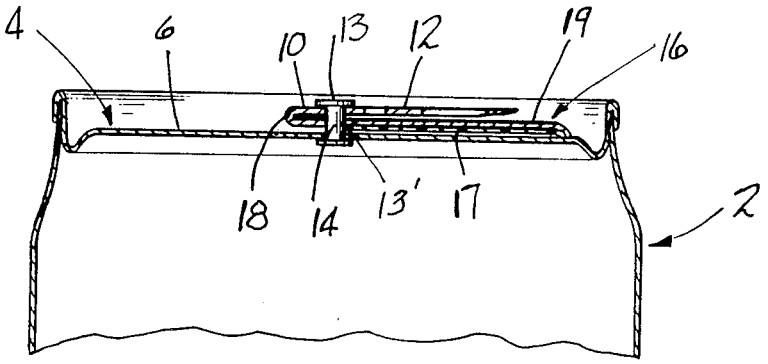
FIG. 2 is a fragmented sectional view of the can taken along line 2—2 of FIG. 1.
Figure 3:
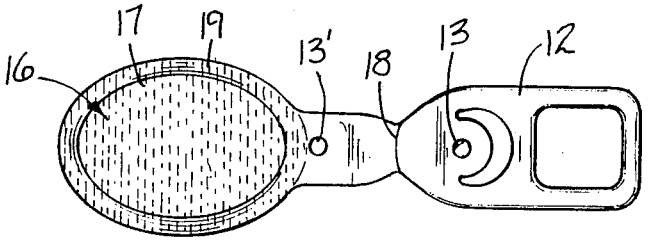
FIG. 3 is a plan view of the punch tab/closure flap component of the invention.
Figure 4:
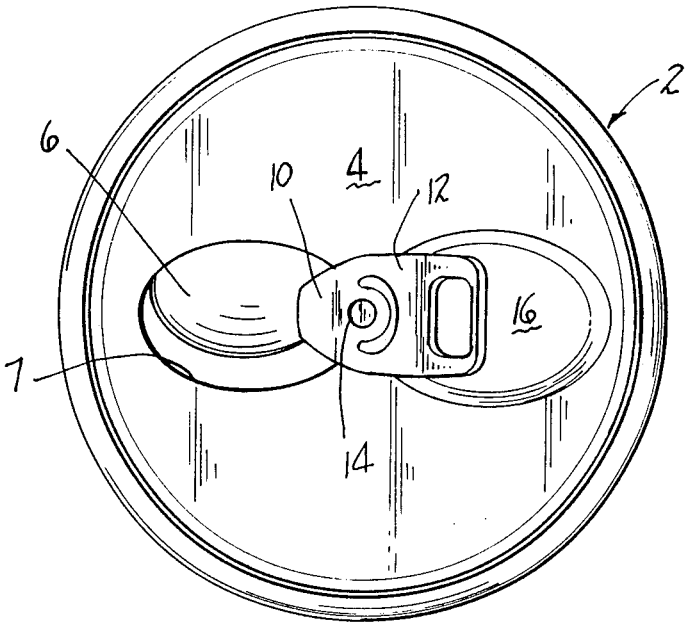
FIG. 4 is a view similar to FIG. 1 but showing the can after the it has been opened.

FIGS. 2 and 3 clarify the construction of the punch tab 12 and closure flap 16. As will be seen from FIG. 3, the closure flap 16 and punch tab 12 are connected by score or fold line 18. One side of the closure flap 16 which faces the can lid 4 is preferably covered with a layer of polyethylene, as shown by the stippling in FIG. 3. A biased peripheral skirt 19 is formed on the closure flap 16 by means of a hinge line 17 to enhance the closure ability of the flap 16. After the closure flap 16 and punch tab 12 are folded about the score line 18 into overlapping relationship, as shown in FIG. 2, the river 14 is passed through aligned openings 13 and 13' in the the punch tab 12 and closure flap 16 respectively, and through the lid 4 of the can 2, as shown in FIG. 2. The punching portion 10 thus overlies the weakened portion 6 in the can lid 4, whereby the can 2 may be opened in conventional fashion, as shown in FIG. 4. When the tab 12 is lifted to pivot the punching portion 10 down about the rivet 14 forcing the portion 6 to break away from the can lid 4 and down into the can 2 to form the pour opening 7, the closure flap 16 remains in place on the can lid 4. In the condition shown in FIG. 4, the beverage can be poured from the can 2.

Figure 5:
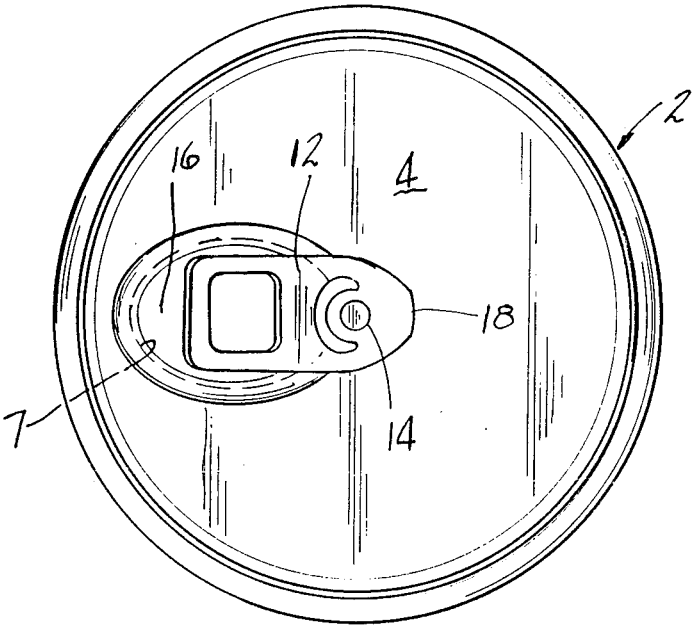
FIG. 5 is a view similar to FIG. 4 but showing the can after the closure flap has been pivoted to its closing position.

To reclose the can 2, the tab 12 is twisted about the rivet 14 through a 180 degree arc. Such movement of the tab 12 drags the closure flap 16 over the can lid 4 into overlying closing relationship with the pouring opening 7 as shown in FIG. 5. The twisting of the tab 12 and flap 16 about the rivet 14 imposes no bending moment on the rivet 14 so that reopening and reclosing of the can 2 may be repeated many times without fracturing the rivet 14, or the parts of the can 2 connected thereto.

It will be readily appreciated that the device of this invention enables one to reclose an opened punch-type easy open can with a closure that is fastened to the can. The closure is a flap which is formed integrally, and in one piece, with the punch tab. By connecting the closure flap to the punch tab by a fold line, and by placing the closure flap beneath the punch tab on the lid of the can, the same rivet can be used to connect both components to the can. Twisting of the punch tab to open and reclose the can, after the can is initially opened, imparts no fracture-inducing stresses to the can components, whereby the can may be reopened and reclosed many times without damaging the mechanism.

Since many changes and variations of the disclosed embodiment of the invention may be made without departing from the inventive concept, it is not intended to limit the invention otherwise than as required by the appended claims.

What is claimed is:

1. An easy open beverage can of the type having a punch open pouring spout formed on the can lid, said can comprising:

(a) a weakened portion on said can lid which separate from the remainder of the can lid to form the pouring spout;

(b) a punch tab secured to said can lid by means of a rivet, said punch tab including an integral punching portion overlying said weakened portion whereby upward pivoting of said punch tab about said rivet results in downward movement of said punching portion onto the weakened portion of said can lid which is operable to separate said weakened portion from the remainder of the can lid and deflect said weakened portion into the can; and (a) a closure flap having a peripheral skirt portion which is bias toward said can lid by a hinge line formed in the closure flap to enhance closure of the pouring spout, said closure flap being connected to said punch tab punching portion by a fold line, and said closure flap being interposed between said punch tab and said can lid and secured to the latter by said rivet, said closure flap being sized to cover the pouring spout, and being operable to close said pouring spout when the punch tab is appropriately twisted about said rivet.

2. The beverage can of claim 1 wherein said closure flap has a polymeric coating on the surface thereof facing said can lid, said coating being operable to enhance closure of the can.

* * * * *